United States Patent [19]

Paoletti

[11] Patent Number: 4,460,090

[45] Date of Patent: Jul. 17, 1984

[54] COMPENSATING CONTAINER, NOTABLY FOR PHARMACEUTICAL PRODUCTS

[75] Inventor: Jean-Claude Paoletti, Enval, France

[73] Assignee: Laboratoires Merck Sharp & Dohme - Chibret, Paris, France

[21] Appl. No.: 397,252

[22] Filed: Jul. 12, 1982

[30] Foreign Application Priority Data

Jul. 20, 1981 [FR] France ..... 81 14084

[51] Int. Cl.[3] ..... B65D 85/56; B65D 77/04

[52] U.S. Cl. ..... 206/540; 215/1 C; 220/85 B; 206/528

[58] Field of Search ..... 215/1 C, 6, 12 R, 13 R; 220/85 B; 206/528, 540, 535, 538

[56] References Cited

U.S. PATENT DOCUMENTS 2,953,304 9/1960 Sellinger ..... 220/85 B X
3,844,407 10/1974 Buie ..... 206/540 X
4,241,839 12/1980 Alberghini ..... 215/1 C X

FOREIGN PATENT DOCUMENTS 1486232 4/1969 Fed. Rep. of Germany ..... 206/540
1076532 4/1954 France .
1513057 1/1968 France .
1329603 9/1973 United Kingdom ..... 215/6

*Primary Examiner*—William Price
*Assistant Examiner*—Sue A. Weaver
*Attorney, Agent, or Firm*—William H. Nicholson; Michael C. Sudol

[57] ABSTRACT

The present invention relates to a container which is notably intended to hold pills, and it comprises on the one hand an external, rigid envelope 10 and on the other hand an internal envelope 11 enclosing the pills, this internal envelope being elastically deformable and capable of an increase in volume which is sufficient for absorbing the surplus pressure resulting from the packing of the pills when the lid is applied, without crushing the pills.

In a first embodiment, the internal envelope 11 is cylindrical and it has a convex, deformable base 12.

In a second embodiment, the internal envelope is a sleeve provided with at least one slit allowing its radial expansion.

1 Claim, 7 Drawing Figures

COMPENSATING CONTAINER, NOTABLY FOR PHARMACEUTICAL PRODUCTS

Figure 2:
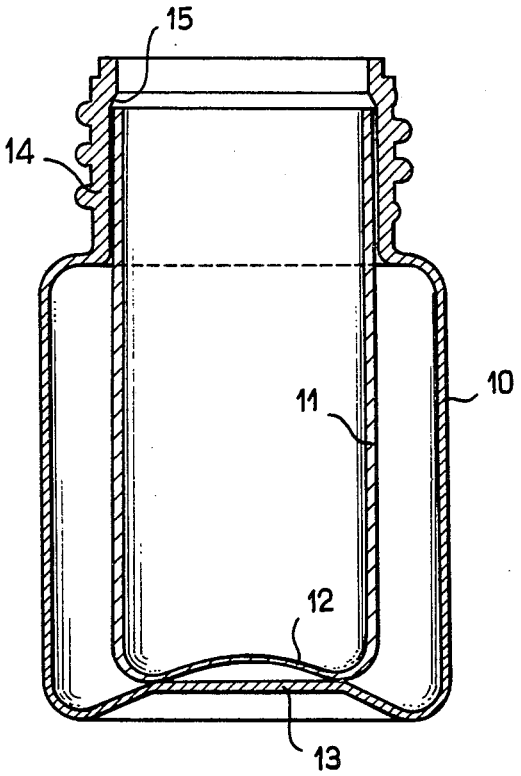

This invention relates to a container intended for solid contents, notably for pharmaceutical products. The term "solid contents" or "pills" will be understood to designate individualized elements, such as pills, pellets, capsules, compressed pills, pastilles or the like. A container of this type is often termed a "pill box", but this term is not restrictive concerning the contents of the box.

Owing to their brittleness, the solid elements present certain problems during the filling of the containers, and then during the transport and handling thereof. If the pill box is not filled to the top, the pills may be displaced during transport and they may break up. If, on the other hand, the box is filled to the top, it may happen that, during filling, a pill slightly projects over the top of the container and is crushed when the lid is applied. Moreover, the contents may sink slightly during transport and the pills which were initially compressed by the lid are nevertheless displaced. In fact, one of the difficulties of packing such contents results from the fact that the final volume of the contents may vary slightly, owing to a fairly narrow imbrication of the individualized elements. Since such containers are filled in bulk, it is impossible to position the solid elements during the filling operation such that they take up a minimum volume. Therefore, there is a double difficulty in compensating for this slight variation in volume, while at the same time applying a slight pressure to the contents so that they cannot be displaced.

One known method for resolving this difficulty consists in using stoppers or lids which are provided inside with lamellae or protuberances, for example in spiral form, acting as a compensator. However, this method also has disadvantages: on the one hand, during the production of the lids and during filling of the pill boxes, it is difficult to loosely arrange the stoppers; in effect, the lamellae or protuberances become entangled and make any mechanization of the operations difficult. In addition, an ordinary screwed stopper with compensator, during the screwing, causes an abrasion of the pills. Such an abrasion is caused by the rubbing of lids on the pills during the rotation of the stopper. Such compensating lids of this type thus necessitate special precautions during their handling. On the other hand, during use, pills remain caught inside the lamellae from where it is difficult for the user to extract them.

In order to alleviate these disadvantages, the present invention proposes a container comprising on the one hand an external rigid envelope having an opening which is capable of being sealed by a lid, and, on the other hand, an internal envelope enclosing the solid contents and positioned completely inside the external envelope, said internal envelope being elastically deformable and capable of an increase in volume sufficient for absorbing the surplus pressure resulting from the packing action of the contents when the lid is applied, without crushing the solid contents.

The internal envelope is dimensioned so that, in the absence of any deformation, the container is filled with all of its useful contents when the contents slightly project over the upper level of the internal envelope.

In this manner, and so that the internal envelope functions as a compensator, it is necessary to stop the filling operation as soon as the level of the contents starts to exceed the upper level of the internal envelope, the predetermined number of pills with which the pill box has to be filled being attained at this moment. After the lid has been applied, the pills will be blocked and will not be able to be displaced and break up during transport.

Another advantage of the present invention results from the fact that it is possible to dimension and to shape the external envelope in any manner, independently of the quantity container. In fact, users, in particular those suffering from arthritis or similar complaints, often have difficulty in opening pill boxes, particularly when these are small and cylindrical, which is very often the case; on the other hand, a large container would hold an excessive number of pills, a large number of which would not be used. The pill box according to the invention solves this problem by virtue of its double wall. Moreover, the internal wall plays the part of a compensator as described above.

In a first embodiment, the internal envelope is cylindrical and is provided with a convex base which is capable of being deformed under the effect of the pressure exerted by the contents, in order to create the necessary increase in volume of the internal envelope.

In a second embodiment, the internal envelope is a sleeve provided with at least one slit allowing its radial expansion under the effect of the pressure exerted by the contents. Advantageously, there is only a single slit and it extends from one end of the sleeve to the other.

Figure 1:
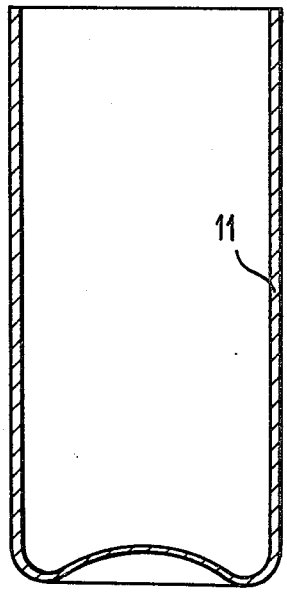
Figure 3:
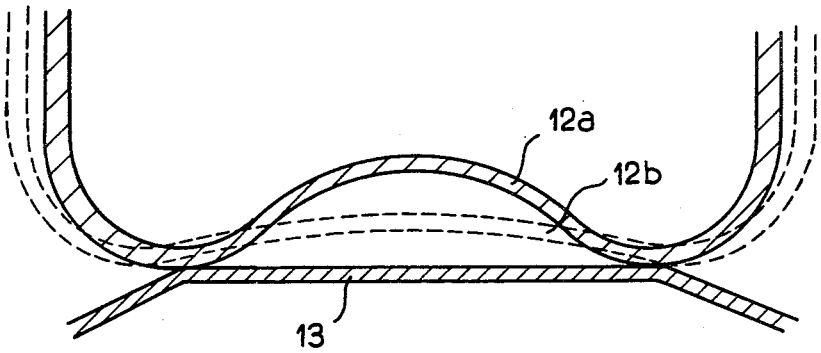
Figure 6:
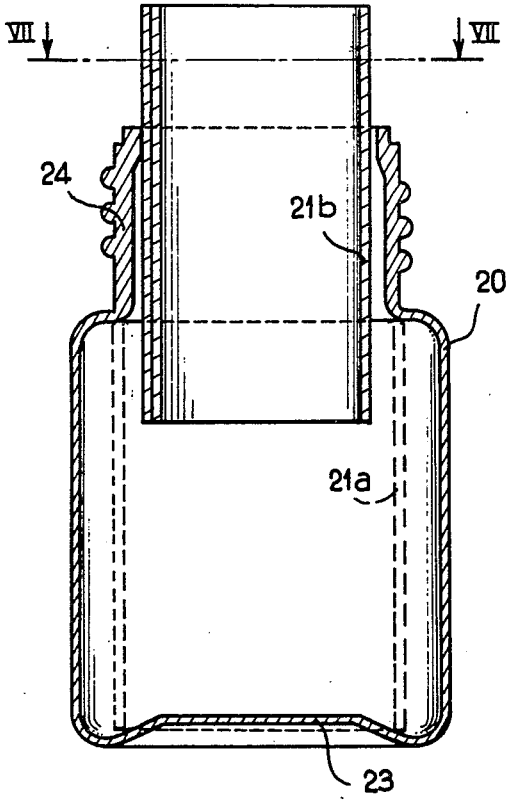
Figure 4:
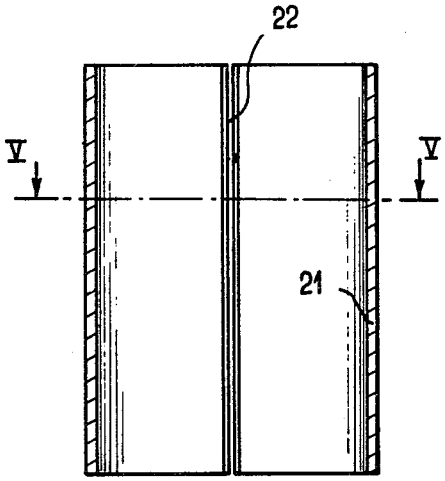
Figure 7:
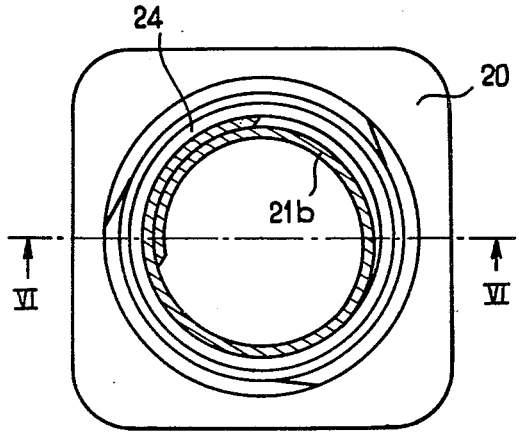
Figure 5:
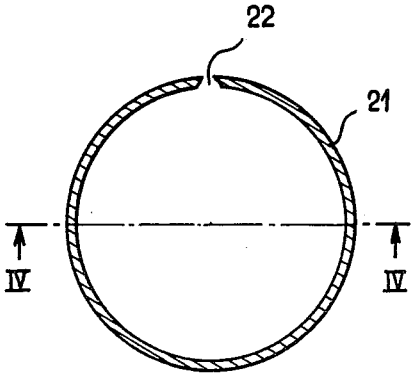

Other characteristics and advantages of the present invention will be revealed from reading the detailed description which follows, with reference to the accompanying drawings which are an integral part of the description. In the drawings:

FIG. 1 illustrates a vertical sectional view of the internal envelope in the first embodiment of the invention, FIG. 2 illustrates in sectional view the same internal envelope which has been positioned inside the external envelope, FIG. 3 is a detail of FIG. 2, illustrating the base of the internal envelope and explaining its compensating role, FIG. 4 illustrates, in a second embodiment, a vertical section of the internal sleeve along line IV—IV of FIG. 5, FIG. 5 is a top view of the same sleeve, in sectional view along line V—V of FIG. 4, FIG. 6 is a section along line VI—VI of FIG. 7, illustrating the external envelope and the sleeve, on the one hand during its introduction and on the other hand in its final position, and FIG. 7 is a top view along line VII—VII of FIG. 6.

FIGS. 1 to 3 illustrate the first embodiment of the pill box according to the invention. It comprises an external envelope 10 made of rigid material, such as glass or polymer, and advantageously it has an angular cross section, for example a square cross section, and it contains an internal envelope 11 made of elastically deformable material, the base 12 of which rests on the base 13 of the external envelope. The external envelope has a shoulder 15 at the top of its neck 14, which shoulder holds the internal envelope in position once it has been introduced. Moreover, the dimensions of the neck 14 and the height of the internal envelope 11 are such that correct centering of the internal envelope 11 inside the external envelope is ensured.

FIG. 3 illustrates how the base 12 acts as a compensator; when the container is empty or before the lid is applied, the base 12 occupies position 12*a*, corresponding to zero deformation. When the lid is applied, the base is deformed by flattening, as illustrated by 12*b*, thus allowing a slight increase in volume, while still maintaining the contents under pressure.

FIGS. 4 to 7 relate to the second embodiment: the external envelope 20 contains a sleeve 21 provided with a slit 22. Once it has been introduced, the sleeve in position 21*a* rests on the base 23 of the external envelope, thus forming the internal envelope which will receive the contents of the pill container.

There is preferably only one slit and it extends from one end of the sleeve to the other. It is also possible to provide a series of slits forming expansion flaps at the bottom of the sleeve, the deformation then taking place at the bottom of the sleeve, and no longer over the complete height of the sleeve as in the case of one slit formed over the complete height thereof. Likewise, although the slit has been illustrated in a straight line, along one of the generatrices of the cylindrical sleeve, other shapes are also possible, for example a helical shape. In all these cases, the characteristic role of the slit is to allow a radial and elastic expansion of the sleeve, so that it acts as a compensator. Moreover, the sleeve is capable of being rolled up so that it may be introduced through the opening 24 of the external envelope, as illustrated in position 21*b* in FIGS. 6 and 7; once it has been completely introduced, the sleeve can unroll into position 21*a*, inside the external envelope 20.

Advantageously, as in the first embodiment, the external envelope has an internal configuration, notably the form of its base 23 which allows the centering of the internal envelope once it has been introduced, while also allowing the slight radial expansion which is necessary.

It is obvious that the two embodiments which have been described above are not restrictive and that numerous variations may be considered without departing from the scope of the present invention.

What is claimed is:

1. A container of the type intended for solid contents, characterized in that it comprises on the one hand an external, rigid envelope, (10), having an opening which is capable of being sealed by a lid, and on the other hand, an internal envelope, (11), enclosing the solid contents and completely positioned inside the external envelope, said internal envelope being cylindrical and provided with a convex base, (12), which is capable of being deformed by increasing in volume sufficiently to absorb the surplus pressure resulting from the packing of the contents when the lid is applied, without crushing the solid contents.

* * * * *